US012297005B2

(12) United States Patent
Bontrager et al.

(10) Patent No.: US 12,297,005 B2
(45) Date of Patent: May 13, 2025

(54) LEAK-RESISTANT TRAY AND LID

(71) Applicant: Congruens Group, LLC, San Carlos, CA (US)

(72) Inventors: Rick Bontrager, San Carlos, CA (US); John Mauriello, San Carlos, CA (US); Esther Lekeu, San Carlos, CA (US)

(73) Assignee: Congruens Group, LLC, San Carlos, CA (US)

( * ) Notice: Subject to any disclaimer, the term of this patent is extended or adjusted under 35 U.S.C. 154(b) by 113 days.

(21) Appl. No.: 17/633,688

(22) PCT Filed: Aug. 19, 2020

(86) PCT No.: PCT/US2020/046999

§ 371 (c)(1),
(2) Date: Feb. 8, 2022

(87) PCT Pub. No.: WO2021/034935

PCT Pub. Date: Feb. 25, 2021

(65) Prior Publication Data

US 2022/0315269 A1 Oct. 6, 2022

Related U.S. Application Data

(60) Provisional application No. 62/889,006, filed on Aug. 19, 2019.

(51) Int. Cl.
*B65D 1/36* (2006.01)
*B65D 43/02* (2006.01)

(52) U.S. Cl.
CPC ..... *B65D 1/36* (2013.01); *B65D 43/0218* (2013.01); *B65D 2543/00462* (2013.01)

(58) Field of Classification Search
CPC ..... B65D 1/36; B65D 2543/00462; B65D 43/0218; B65D 2543/00731
(Continued)

(56) References Cited

U.S. PATENT DOCUMENTS 5,398,836 A * 3/1995 Luch ..... B65B 7/28 220/276
5,915,581 A 6/1999 Pfirrmann, Jr. et al.
(Continued)

FOREIGN PATENT DOCUMENTS

CN 101282885 A 10/2008
CN 101641193 A 2/2010
(Continued)

OTHER PUBLICATIONS

PCT International Search Report for PCT Application No. PCT/2020/046999 mailed Sep. 12, 2020 (4 pages).
(Continued)

*Primary Examiner* — Steven A. Reynolds
(74) *Attorney, Agent, or Firm* — Goodwin Procter LLP

(57) ABSTRACT

A container includes a molded tray and a molded lid, both made of unitary fiber bodies. The tray includes at least one internal well and a perimeter engaging wall extending upward from a perimeter rim. The perimeter engaging wall includes an inner surface, an outer surface, and an uppermost surface. The lid includes a ceiling and defines a perimeter engaging receiver extending upward from a perimeter rim. The rim is defined by an inner wall, an outer wall, and an uppermost wall. The perimeter engaging wall is configured to be removably received in the perimeter engaging receiver.

12 Claims, 20 Drawing Sheets

(58) Field of Classification Search
USPC ..... 206/562; 220/796, 780, 276
See application file for complete search history.

(56) References Cited

U.S. PATENT DOCUMENTS

| | | | | |
|---|---|---|---|---|
| 6,120,863 | A | 9/2000 | Neculescu et al. | |
| 7,871,653 | B2 | 1/2011 | Lin | |
| 2001/0047994 | A1* | 12/2001 | von Holdt, Jr. .... | B65D 21/0219 220/276 |
| 2004/0144781 | A1* | 7/2004 | Dees ..... | B65D 43/0204 220/4.24 |
| 2007/0267374 | A1 | 11/2007 | Middleton et al. | |
| 2010/0181226 | A1* | 7/2010 | Kovacevich ..... | B65D 1/36 206/562 |
| 2017/0013980 | A1 | 1/2017 | Pickett | |
| 2017/0166363 | A1 | 6/2017 | Ng | |
| 2018/0334295 | A1* | 11/2018 | Wang ..... | B65D 43/0208 |
| 2021/0198015 | A1* | 7/2021 | Kui ..... | B65D 43/0239 |
| 2021/0206540 | A1* | 7/2021 | Zhang ..... | B65D 43/0208 |

FOREIGN PATENT DOCUMENTS

| | | | |
|---|---|---|---|
| CN | 103596742 | A | 2/2014 |
| CN | 105143057 | A | 12/2015 |
| CN | 105209345 | A | 12/2015 |
| CN | 105228916 | A | 1/2016 |
| EP | 0544429 | | 6/1993 |
| JP | 4157130 | B2 | 9/2008 |

OTHER PUBLICATIONS

PCT Written Opinion for PCT Application No. PCT/2020/046999 mailed Sep. 12, 2020 (8 pages).

* cited by examiner

LEAK-RESISTANT TRAY AND LID

CROSS-REFERENCE TO RELATED APPLICATIONS

This application is a National Stage Application of PCT/US2020/046999, filed 19 Aug. 2020, which claims the benefit of U.S. Provisional Patent Application Ser. No. 62/889,006, filed Aug. 19, 2019, and which is entitled "LEAK-RESISTANT TRAY AND LID," the disclosures of which are hereby incorporated by reference herein in their entirety.

INTRODUCTION

Containers for the storage and transport of food include a tray and a lid, which may be separate or interconnected (e.g., clamshell). The tray and/or lid may be made from container materials including one or more of molded fiber or paperboard, plastic, or metal (e.g., aluminum). In some cases, an aluminum container is used in conjunction with a plastic lid, both components may be made of plastic, or molded fiber may be combined with plastics, and so on. Often, such containers merely contain the food for a limited time (sufficient to transport the food from a restaurant to home), but do not have sufficient structural integrity to prevent leaks. Leaks may occur due to failure of the material itself, a penetration of liquid between the tray and the lid, or a failure of a clean seal between the tray and lid due to manufacturing error and/or difficulties. This problem is especially apparent in containers that are made from organic (e.g., containing cellulose) materials such as molded fiber. Chemical and/or wax additives added to molded fiber to create the container material may improve the container material resistance to failure or penetration, but may limit the compostability or other desired features. Similarly, molded fiber manufacturing, due to its form (geometry) and aesthetic limitations, has typically been limited to the egg tray and industrial packaging markets.

SUMMARY

In one aspect, the technology relates to a container having: a molded fiber tray having: a unitary fiber body defining at least one internal well, wherein the molded fiber body has a perimeter engaging wall extending upward from a perimeter rim of the molded fiber tray, the perimeter engaging wall has an inner surface, an outer surface, and an uppermost surface spanning the inner surface and the outer surface; and a molded fiber lid including: a unitary fiber body having at least one ceiling, and wherein the unitary fiber body defines a perimeter engaging receiver extending upward from a perimeter rim of the molded fiber lid, the perimeter engaging receiver at least partially defined by an inner wall, an outer wall, and an uppermost wall spanning the inner wall and the outer wall, wherein the perimeter engaging wall is configured to be removably received in the perimeter engaging receiver, wherein, when so received, the inner surface contacts the inner wall, the outer surface contacts the outer wall, and the uppermost surface contacts the uppermost wall, and wherein, when so received, the at least one internal well and the at least one ceiling define a substantially sealed internal volume. In an example, unitary fiber body of the molded fiber tray further includes at least one partition that subdivides the internal well into a plurality of wells, and wherein the unitary fiber body of the molded fiber lid defines at least one internal channel that subdivides the at least one ceiling into a plurality of ceilings, wherein the at least one internal channel is configured to mate with the at least one partition, and wherein, when so mated, each of the plurality of wells and plurality of ceilings define a discrete substantially sealed internal volume. In another example, the perimeter rim of the molded fiber tray is disposed substantially orthogonal to the outer surface and the inner surface. In yet another example, the perimeter rim of the molded finer tray has an outer rim disposed adjacent the outer wall and an inner rim disposed adjacent the inner wall, and wherein the inner rim is adjacent the at least one well. In still another example, the perimeter rim of the molded fiber lid is disposed substantially orthogonal to the outer wall and the inner wall.

In another example of the above aspect, the perimeter rim of the molded fiber lid has an outer rim disposed adjacent the outer surface and an inner rim disposed adjacent the inner surface, and wherein the molded fiber lid further includes at least one soffit disposed between the inner rim and the at least one ceiling. In an example, the molded fiber lid further includes at least one tab extending from the perimeter rim. In another example, the at least one partition has a major partition extending from a first side of the molded fiber tray to a second side of the molded fiber tray. In yet another example, the at least one partition further includes a minor partition extending from a third side of the molded fiber tray to the major partition. In still another example, the uppermost surface of the perimeter engaging wall at least partially defines a groove. In another example, the groove is continuous. In another example, the at least one partition at least partially defines a groove.

In another aspect, the technology relates to a container having: a molded fiber tray having: a unitary fiber body defining at least two internal wells, separated by a partition having a first well surface, a second well surface, and a partition uppermost surface spanning the first well surface and the second well surface, wherein the molded fiber body has a perimeter engaging wall extending upward from a perimeter rim of the molded fiber tray and at least partially surrounding both of the two internal wells, the perimeter engaging wall having an inner surface, an outer surface, and an uppermost surface spanning the inner surface and the outer surface, wherein the perimeter engaging wall uppermost surface at least partially defines a groove therein, and wherein the perimeter engaging wall uppermost surface is disposed at an elevation different than an elevation of the partition uppermost surface; and a molded fiber lid having: a unitary fiber body including at least one ceiling, a soffit extending from the at least one ceiling and defining an internal recess, a perimeter engaging receiver extending upward from a perimeter rim of the molded fiber lid, the perimeter engaging receiver at least partially defined by an inner wall, an outer wall, and an uppermost wall spanning the inner wall and the outer wall, wherein the partition is configured to be removably received in the internal recess, wherein, when so received, the soffit contacts at least one of the first well wall and the second well wall, wherein the perimeter engaging wall is configured to be removably received in the perimeter engaging receiver, wherein, when so received, the inner surface contacts the inner wall, the outer surface contacts the outer wall, and the uppermost surface contacts the uppermost wall, and wherein, when so received, the at least one internal well and the at least one ceiling define a substantially sealed internal volume.

BRIEF DESCRIPTION OF THE DRAWINGS

There are shown in the drawings examples that are presently preferred, it being understood, however, that the invention is not limited to the precise arrangements and configurations shown.

DETAILED DESCRIPTION

Figure 1A:
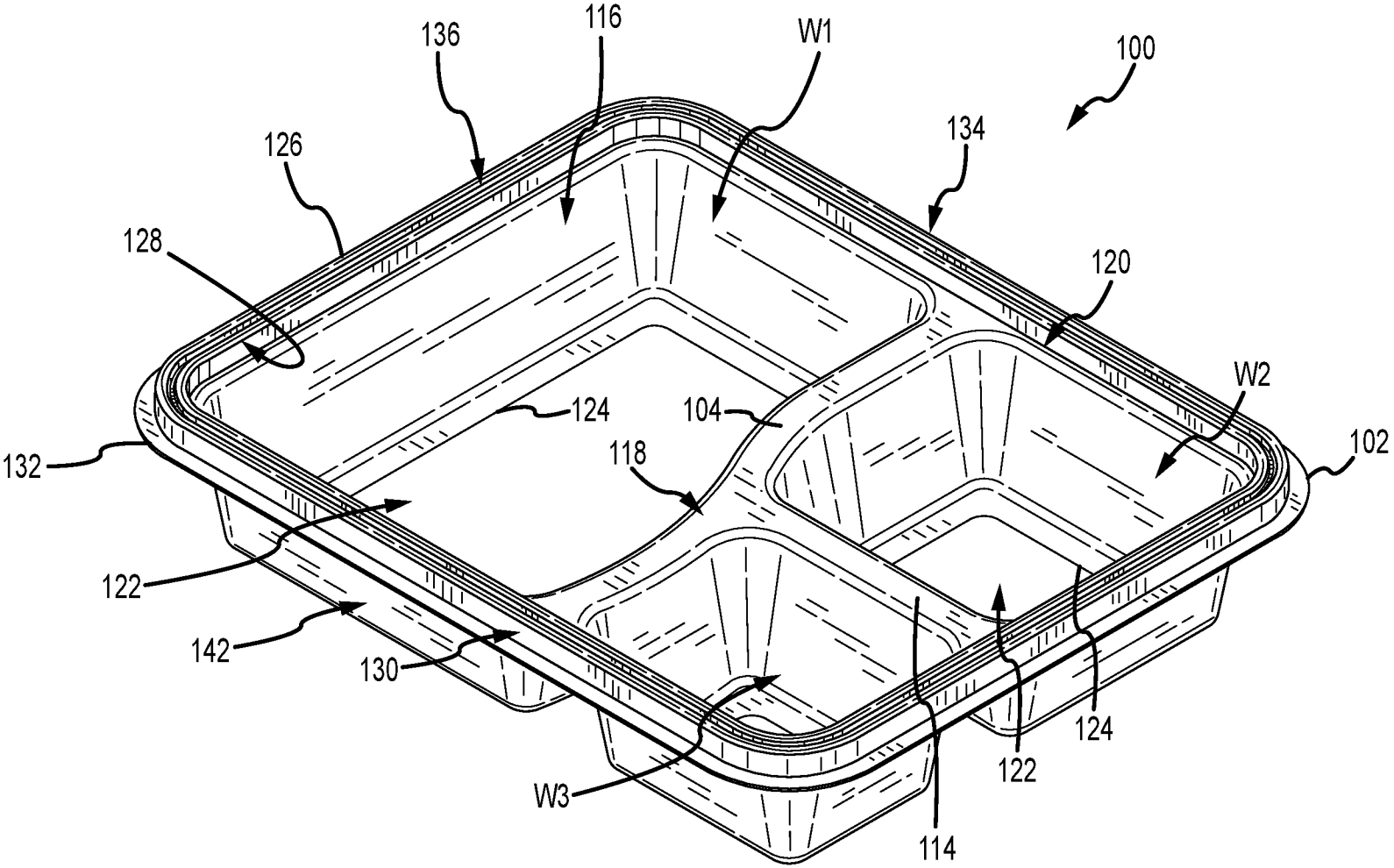
FIGS. 1A-1H are various views of an example of a molded fiber tray.
Figure 1B:
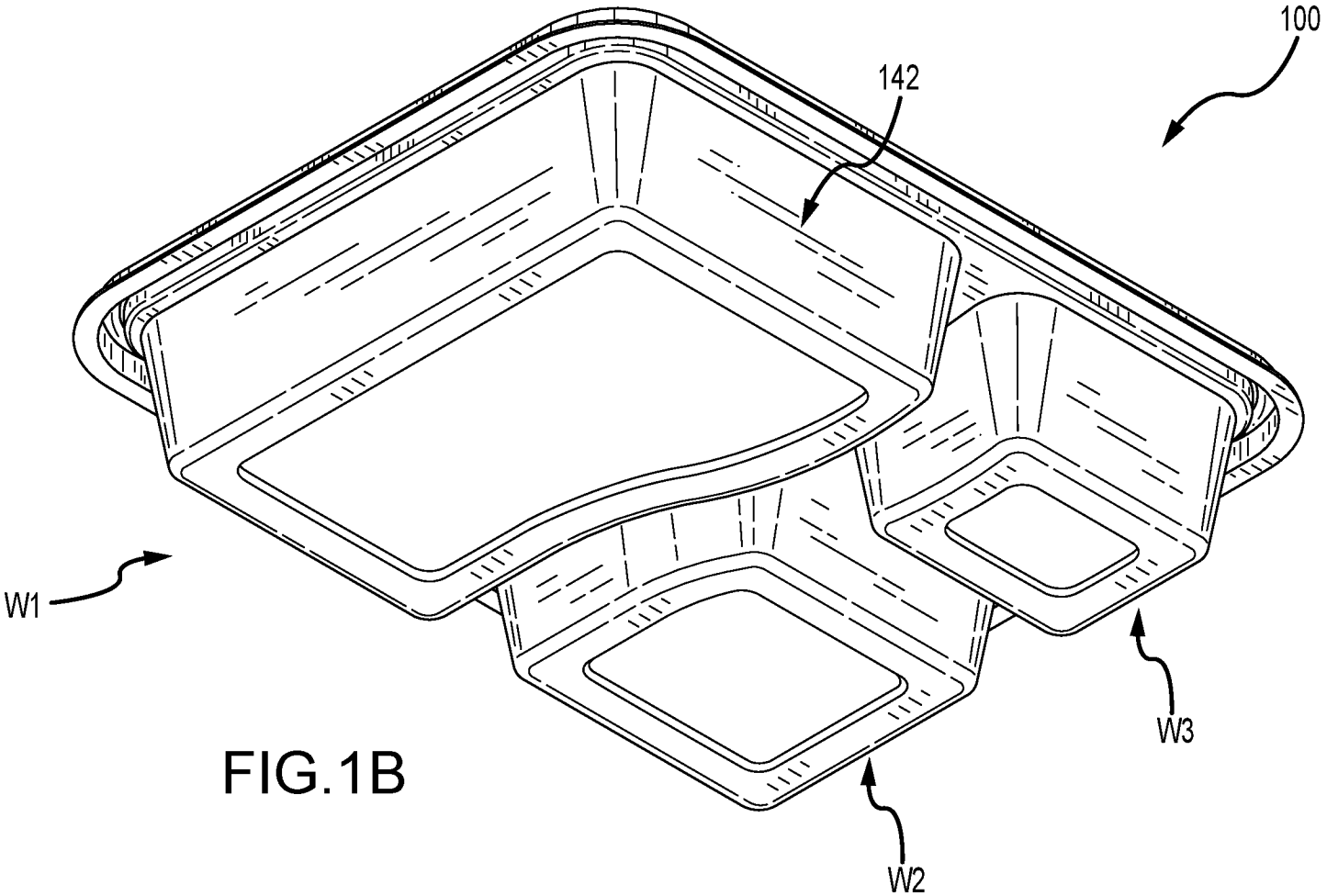
Figure 1C:
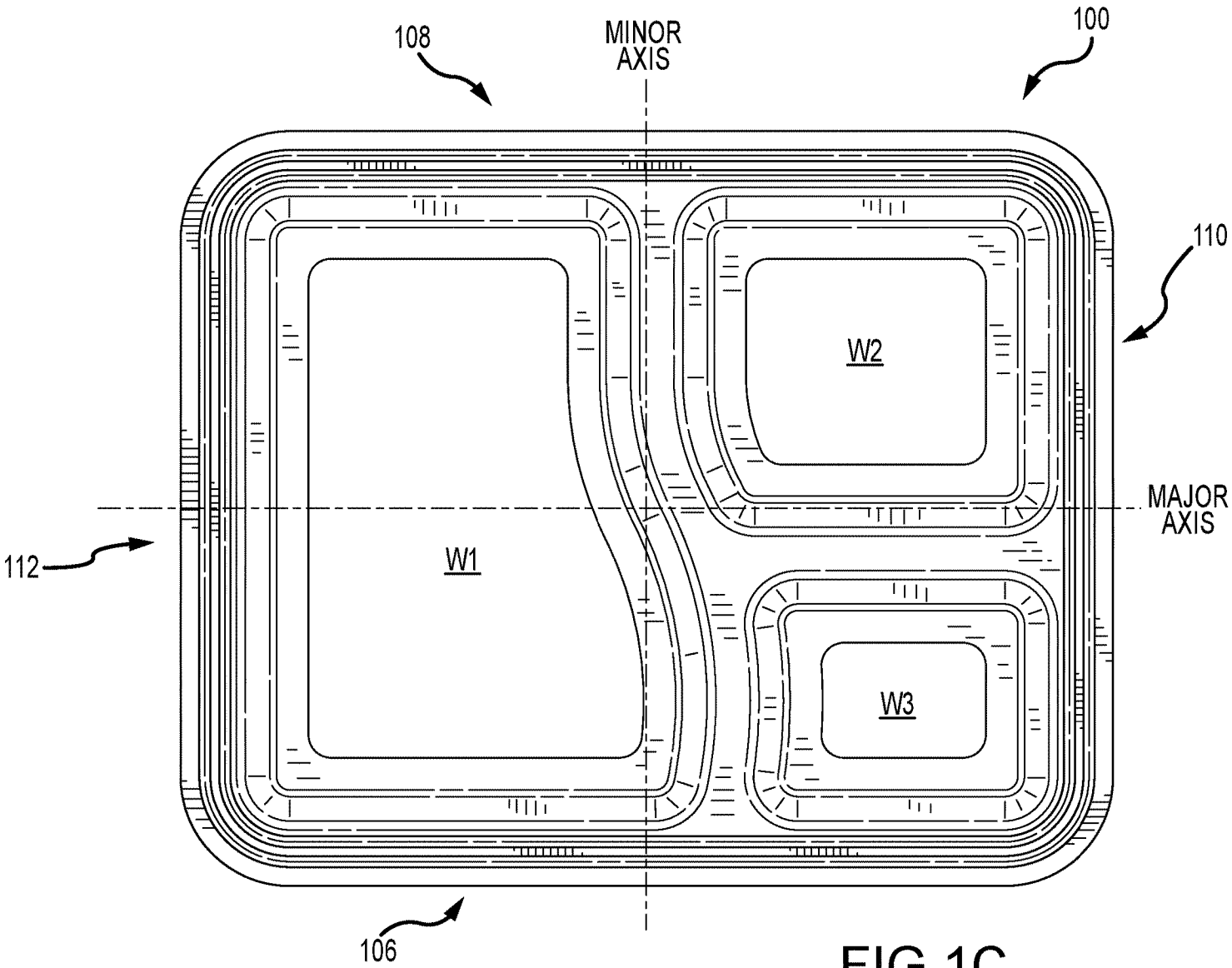
Figure 1D:
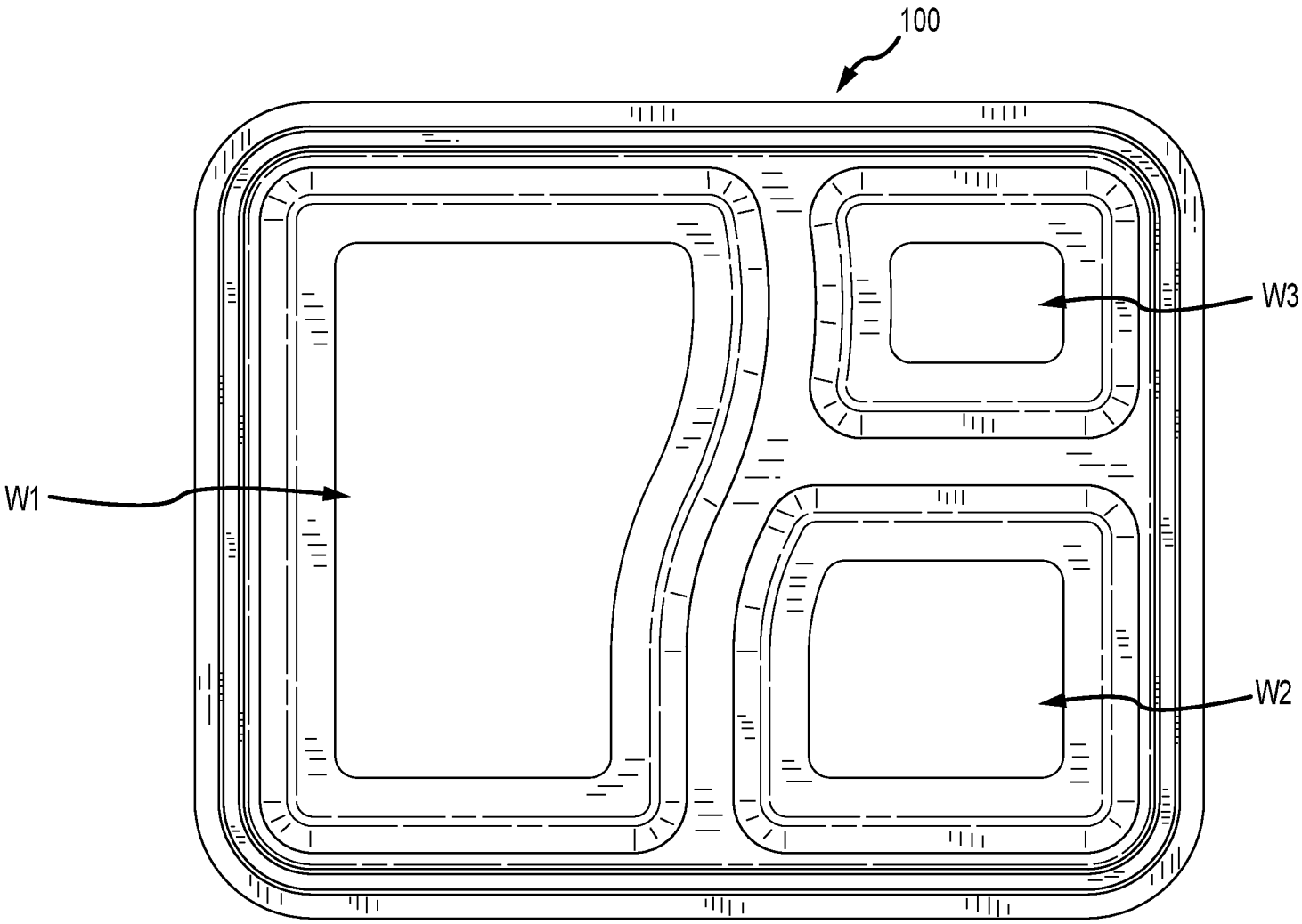
Figure 1E:
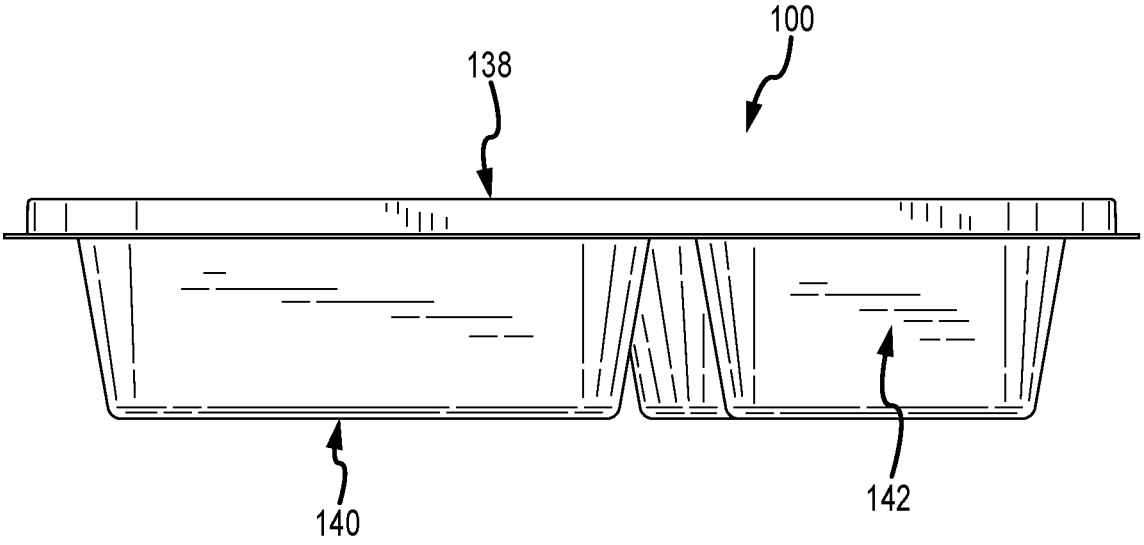
Figure 1F:
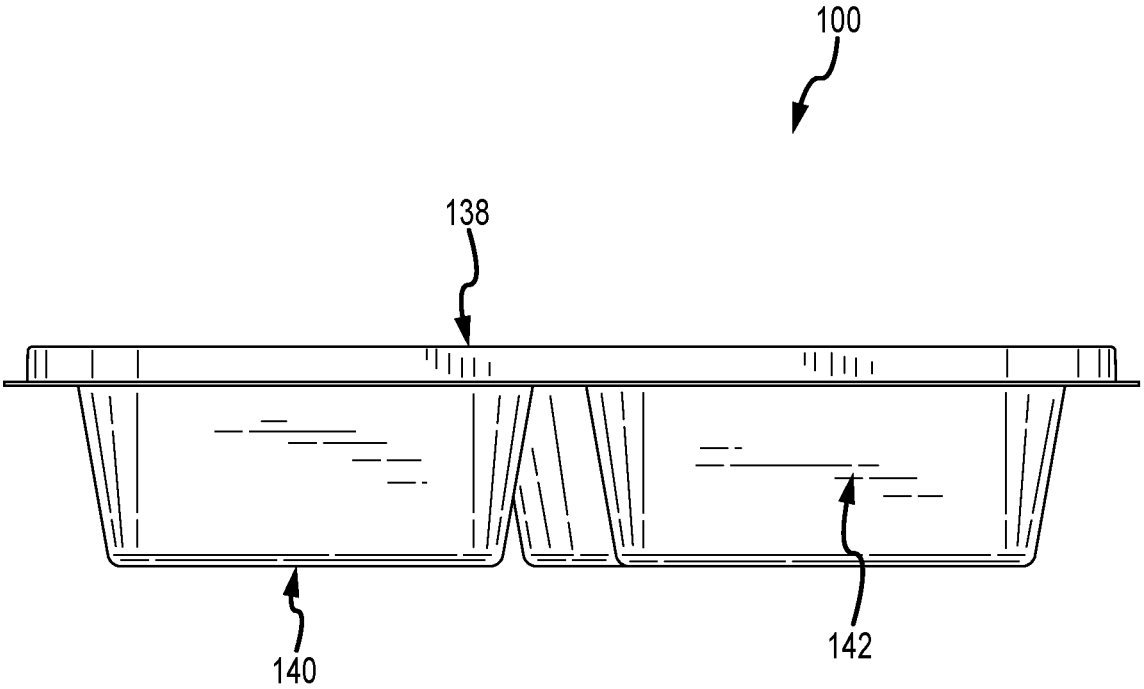
Figure 1G:
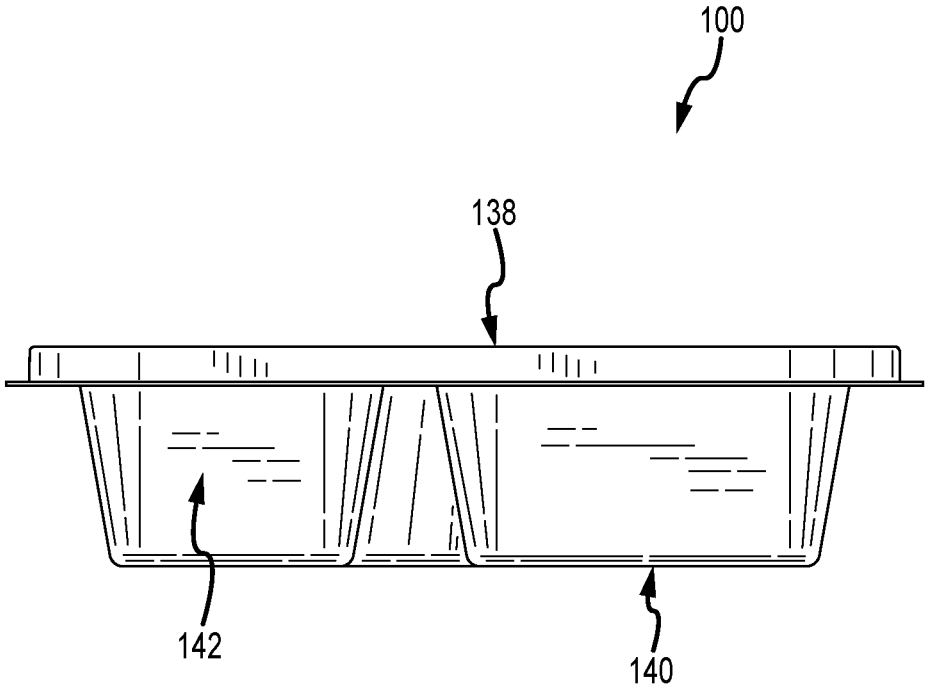
Figure 1H:
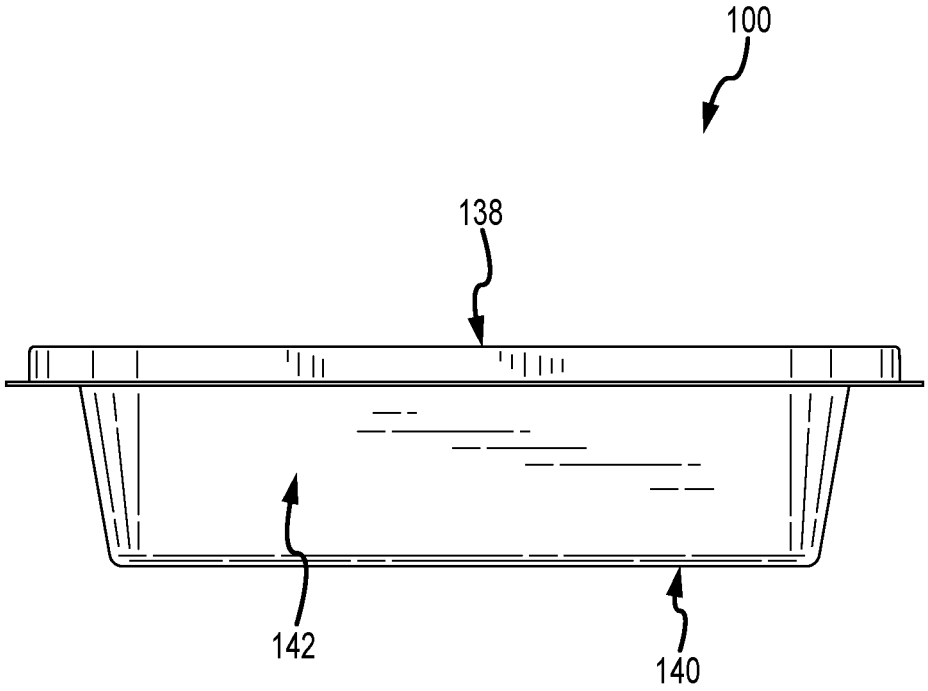

Containers described herein include a tray portion made of molded fiber and a mating lid portion made of molded fiber. Specific materials, as well as methods of making such trays and lids, are also described. In general, the trays and lids described are connected at an interface portion, typically around an entire perimeter of the tray and lib, though other interior interface portions may be present in certain examples as depicted herein. The interface portion includes a wall formed on the tray that is received in a receiver defined by the lid. In other examples, the receiver may be defined by the tray, while the wall may project from a bottom of the lid. Additional surfaces adjacent this wall and receiver structure further seal the container when closed. These additional surfaces (along with the surfaces of the wall and receiver) include a number of surfaces disposed at various angles to each other. These various surfaces are connected to adjacent surfaces at curved transition surfaces. It has been determined that curved transition surfaces are more structurally sound and resist deformation better than sharp transition surfaces. The interface portion of the lid includes surfaces (again disposed at angles to each other) and curved transition surfaces. The interface portion of the lid is formed in a profile that matches, or substantially matches, the profile of the interface portion of the tray. Thus, when the interface portion of the tray and lid are engaged, these mating angled and curved surfaces form a reinforced structure that resists deformation due to forces that may be applied at any angle to the interface portion (e.g., during transport, if the container is dropped, or when the lid is pressed onto the tray).

The contacting surfaces of the tray and lid define a convoluted path that resists leakage of liquid therebetween, e.g., due to increased pressure of the fluid therein. For example, if the filled, closed container is being acted upon by a vertical downward force (e.g., if it is packed in the bottom of a full carrying bag), the liquid inside must travel a convoluted path to escape the container. This convoluted path is defined by the mating surfaces of the tray and lid. The change in orientation of the various surfaces along the potential fluid path are formed by the various angled surfaces, thus reinforcing the interface. This requires significantly higher internal liquid pressure for leakage to occur.

Containers may be formed to include one or more internal wells for food. Wells are separated by internal partitions formed in the body of the tray. The lid includes a corresponding number and configuration of channels that mate with the upper portions of the partitions. This mating between the partitions and channels prevents leakage between the various internal wells (referred to herein as "cross-contamination"). Further, since the partitions are formed by the body of the tray itself, adjacent wells are not disposed on opposite sides of a single, thin portion of material. Rather, each well has a dedicated wall and adjacent walls are separated by ambient air. This allows hot and cold foods to be placed in different wells of the same container, without heat transfer there between due to conduction or cross-contamination of contents.

Materials that may be used in the manufacture of the molded fiber tray and lid include those described in U.S. Pat. No. 10,036,126, entitled "Methods for Manufacturing Fiber-Based Beverage Lids," the disclosure of which is hereby incorporated by reference herein in its entirety. These materials include, generally, a mixture of hardwood and softwood fibers, along with trace amounts of other additives, such as a strengthener, grease repellant, and water repellant. Contacting surfaces of the tray and lid may be both smooth, both rough, or one may be smooth and one may be rough. Roughness of the surface may be obtained by incorporating a mesh screen into the mold utilized for formation of the tray and/or lid. Alternatively, a surface may be roughened after manufacture of the tray or lid, for example, by mechanical processes.

FIGS. 1A-1H are various views of a molded fiber tray 100. The features described with regard to the tray 100 are primarily in reference to annotated FIG. 1A, an upper perspective view of the molded fiber tray 100. FIGS. 1B-1H depict other views of the tray 100: bottom perspective, top, bottom, front, back, right side, left side. FIGS. 1B-1H are provided for further clarity and context, although not every feature is identified by number in every figure. Regardless, further construction details of the tray 100 would be apparent to a person of skill in the art upon reading the following description.

The tray 100 is formed as a unitary molded fiber body 102, having features, contours, and surfaces, as described herein. The body 102 forms one or more wells (identified in FIG. 1A as W1, W2, and W3). Well W1 is separated from well W2 and well W3 by a major partition 104. As used herein, the term "major partition" describes an internal partition between adjacent wells that terminates at a side (that is, a front side 106, a back side 108, a right side 110, and a left side 112) of the tray 100 itself. Well W2 and well W3 are separated by a minor partition 114. As used herein, the term "minor partition" describes an internal partition between adjacent wells that terminates at a side (e.g., front 106, back 108, right 110, left 112) and another partition (e.g., major partition 104). Freestanding partitions (e.g., partitions that project upward from a bottom of the tray 100 or that contact a single side or other partition) may also be utilized, for example, to disrupt fluid flow within the container to reduce or eliminate "sloshing" of liquids therein. The major partition 104 and minor partition 114 form some of the inner surfaces 116 of the various wells and include an uppermost surface 118 that spans the inner surfaces 116 of adjacent wells. In the depicted example, the uppermost surface 118 of the major 104 and minor partitions 114 are level with a tray perimeter inner rim 120. The floor 122 of each well W1, W2, W3 may be flat across the entire expanse thereof, or may include one or more steps 124 therein, which can define further structural integrity. Steps 124 may also be used to define a logo or other decorative feature into the tray 100. Structures having a plurality of steps may form a freestanding partition.

The tray perimeter inner rim 120 is adjacent to a perimeter engaging wall (PEW) 126. This PEW 126 is a part of the sealing interface formed by engagement of the tray 100 and lid. The PEW 126 includes an inner surface 128 and an outer surface 130. Further details of the inner surface 128 and outer surface 130 are provided below. The inner surface 128 projects substantially upward from the perimeter inner rim 120, while the outer surface 130 projects substantially upward from a perimeter outer rim 132. The perimeter outer rim 132 projects from the side of the tray 100 and acts to help seat the lid on the tray 100, as described below. The PEW 126 also includes an uppermost surface 134 that spans the inner surface 128 and outer surface 130. The uppermost surface 134 may define therein a continuous groove 136 that extends the extent of the uppermost surface 134. In other examples, the groove 136 may be intermittent or partial along one or more portions of the uppermost surface 134. The groove 136 enables the PEW 126 to resist deformation that may commonly occur when the lid is being engaged with the tray 100. The groove 136 is depicted as substantially curved in cross-sectional profile shape, but may be V-shaped. In another example, a profile of the curve 136 may define a semi-circle or a smaller portion of a circle. In examples, a groove 136 may also be formed in the uppermost surface of a major or minor partition, as depicted and described elsewhere herein.

In general, the depicted tray 100 is a four-sided element defined a major axis and a minor axis. Opposing sides are parallel to a single axis. For example, sides 110 and 112 are parallel to the minor axis, while sides 106 and 108 are parallel to the major axis. Further, while the term "sides" is used to describe the outer lateral limits of the tray 100, the sides may further be defined by their location relative to a predetermined point of view. For example, the terms "front," "back," "right," and "left," may also be used to describe certain of the sides, in this case, the sides parallel to one of the axes. Thus, location of a particular well, for example, may be described based on the side(s) to which they are adjacent. Well W1, for example, is located adjacent the front 106, left 112, and back 108 sides of the tray 100, while well W3 is located adjacent the back 108 and right 110 sides and is further bounded by the major 104 and minor 114 partitions. The major and minor axes may also be used to describe the orientation of the various partitions, which may be straight, curved, at non-orthogonal angles to both the major and minor axes, etc. While the depicted tray 100 includes four sides, trays having other configurations of sides, such as five, six, or eight, are also contemplated. Trays having an equal number of sides are most likely to be utilized commercially. The terms "top" 138 and "bottom" 140 are used to describe, respectively, the upper and lower limits of the tray 100.

As noted, the tray body 102 is formed from a unitary piece of molded material, having a material thickness generally consistent along its entire exposed area, within manufacturing tolerances. In examples, the material may be molded to a material thickness of about 1.0 mm to about 1.3 mm. In examples, 1.15 mm has shown particularly desirable results and performance. Material thickness may be further modified based on the material (e.g., food) being held in the tray 100; that is, lighter food having a lower moisture content (e.g., popcorn) may not require as thick of a material as heavier food having a higher moisture content (e.g., stew). Thus, material thicknesses of about 0.8 mm to about 1.5 mm and about 0.6 mm to about 1.7 mm are also contemplated. The materials utilized in the manufacture of the tray 100 may be molded fiber, such as described in U.S. Pat. No. 10,036,126, entitled "Methods for Manufacturing Fiber-Based Beverage Lids," the disclosure of which is hereby incorporated by reference herein in its entirety.

FIGS. 2A-2H are various views of a molded fiber lid 200. The features described with regard to the lid 200 are primarily in reference to annotated FIG. 2A, a bottom perspective view of the molded fiber lid 200. FIGS. 2B-2H depict other views of the lid 200: top perspective, top, bottom, front, back, right side, left side. FIGS. 2B-2H are provided for further clarity and context, although not every feature is identified by number in every figure. Regardless, further construction details of the lid 200 would be apparent to a person of skill in the art upon reading the following description.

The lid 200 is formed as a unitary molded fiber body 202, having features, contours, and surfaces, as described herein. The body 202 forms one or more well ceilings (identified in FIG. 2A as well ceiling C1, well ceiling C2, and well ceiling C3). Well ceiling C1 is separated from well ceiling C2 and well ceiling C3 by an internal channel 204 that corresponds to the major partition 104 of the tray 100. Well ceiling C2 and well ceiling C3 are also separated by an internal channel 214 that corresponds to the minor partition 114 of the tray 100. Other channels may be present for any freestanding partitions and may support a ceiling of the tray, e.g., for a particularly wide well. The internal channels 204, 214 include an internal channel uppermost surface 218, which contacts the partition uppermost surface 118 when the lid 200 is engaged with the tray 100. Soffits 216 extend from the uppermost surface 218 to each well ceiling C1, C2, C3, thus locating the ceiling C1, C2, C3 of any particular well W1, W2, W3 below the uppermost surface 218 of the partitions 104, 114. This help to seal each individual well W1, W2, W3 from the others, thus preventing cross-contamination. In the depicted example, the uppermost surface 218 of internal channels 204, 214 are generally level with a lid perimeter inner rim 220.

Figure 2A:
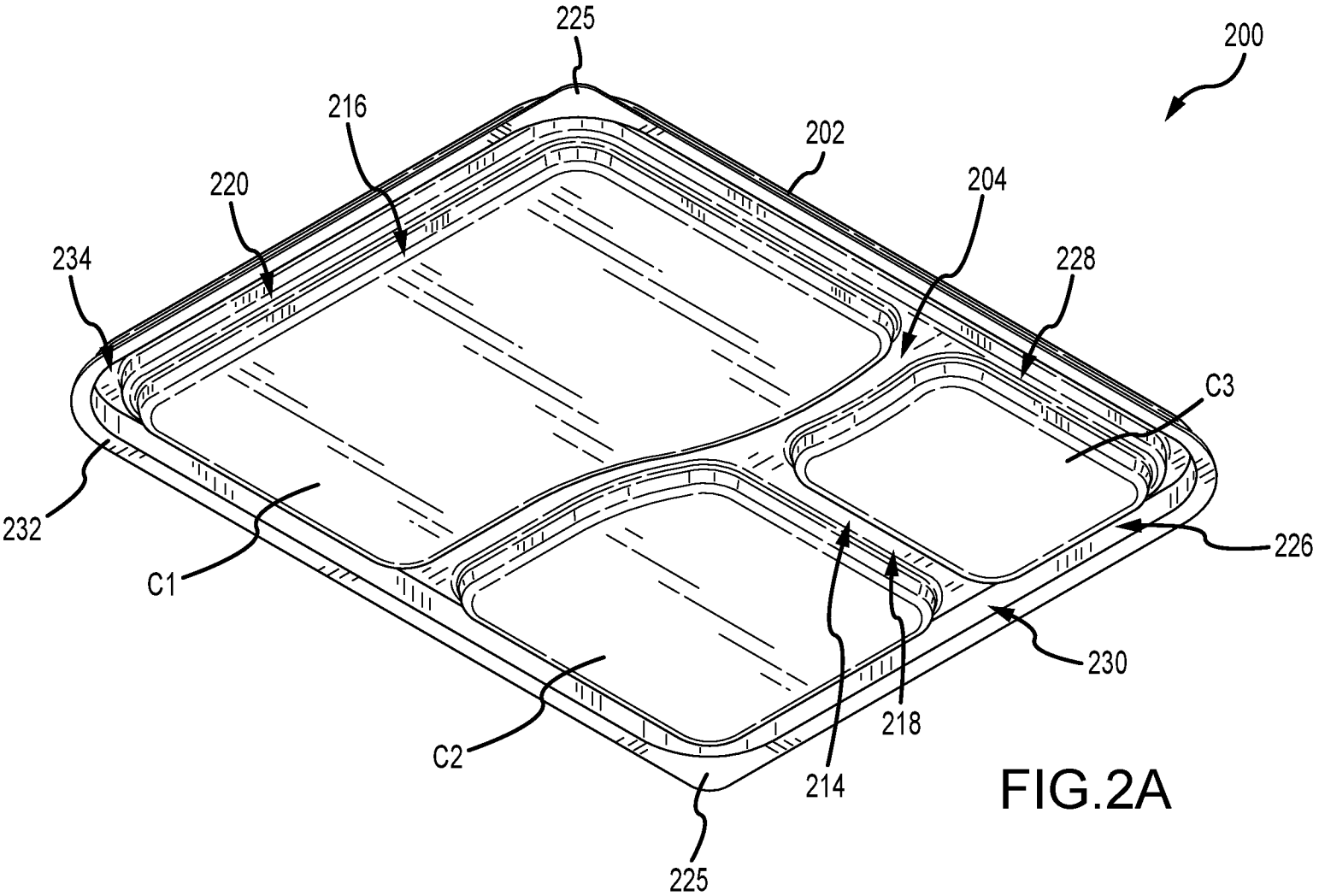
FIGS. 2A-2H are various views of an example of a molded fiber lid.
Figure 2B:
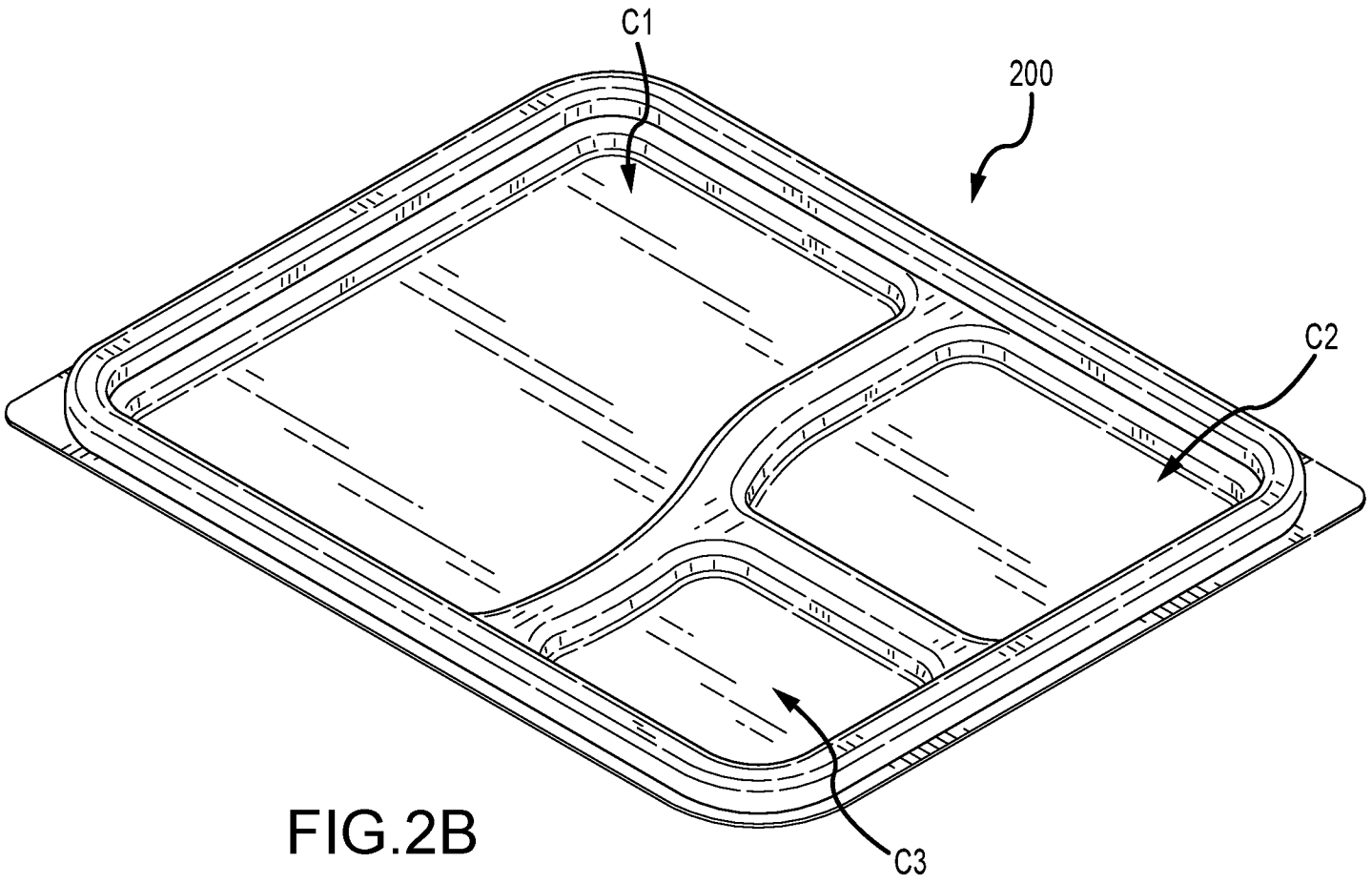
Figure 2C:
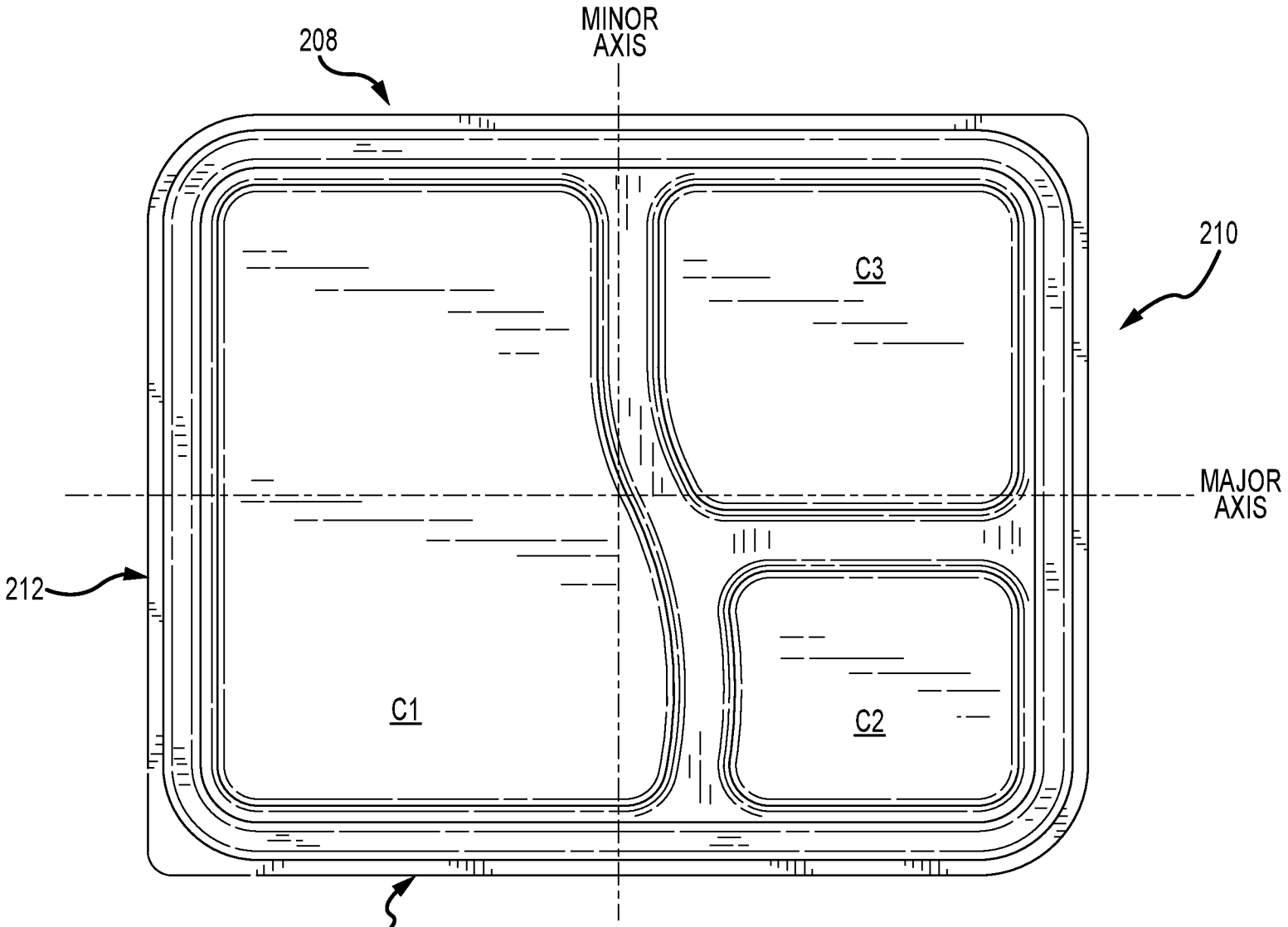
Figure 2D:
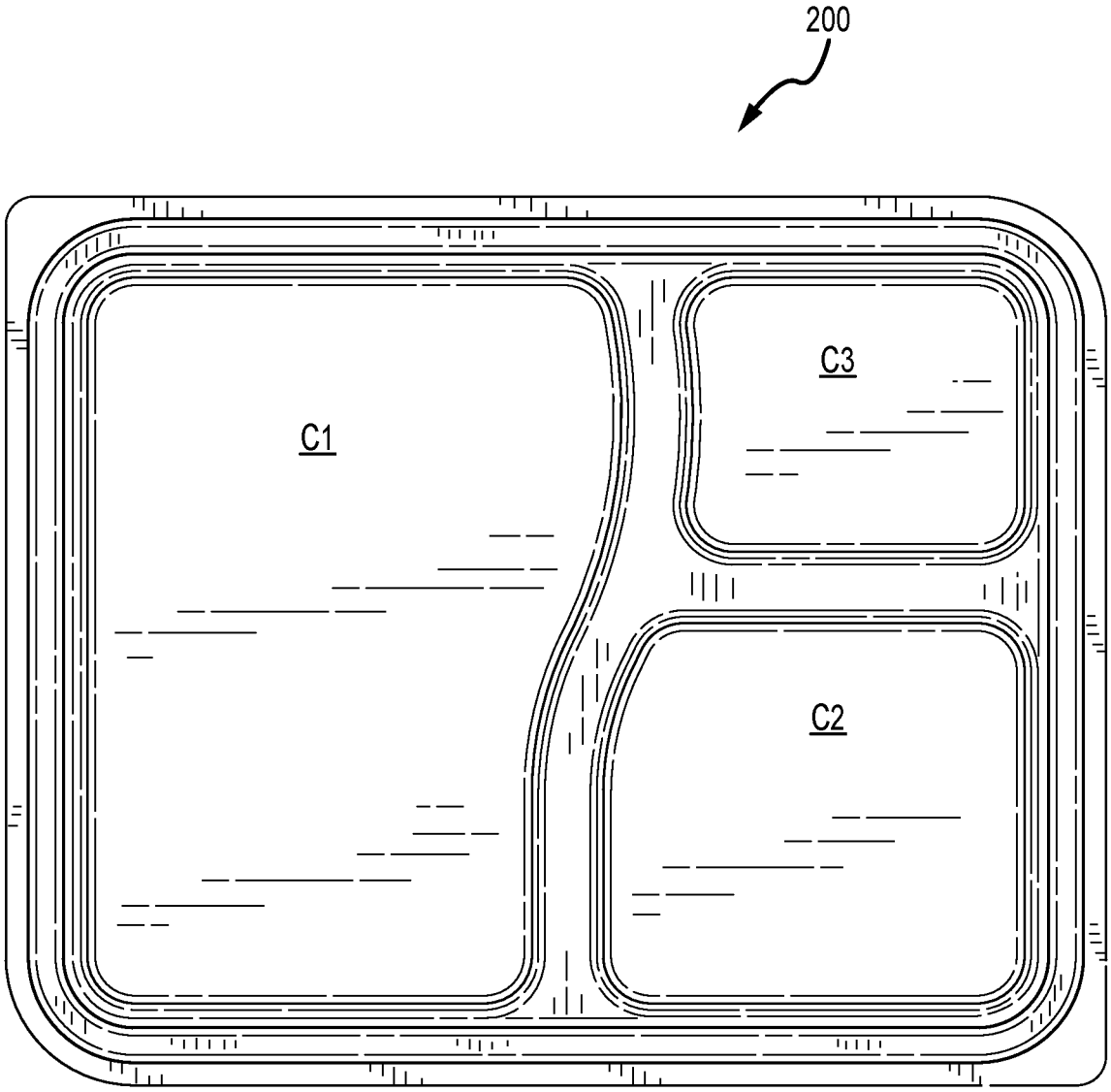
Figure 2E:
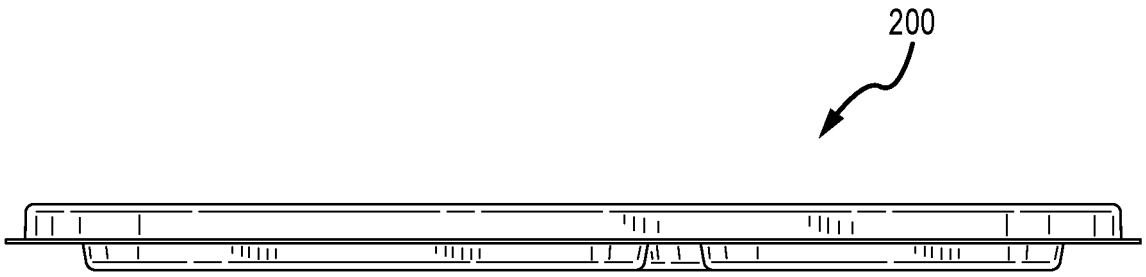
Figure 2F:
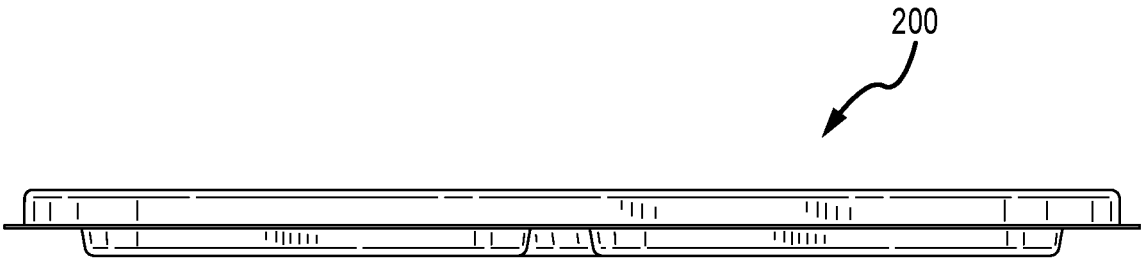
Figure 2G:
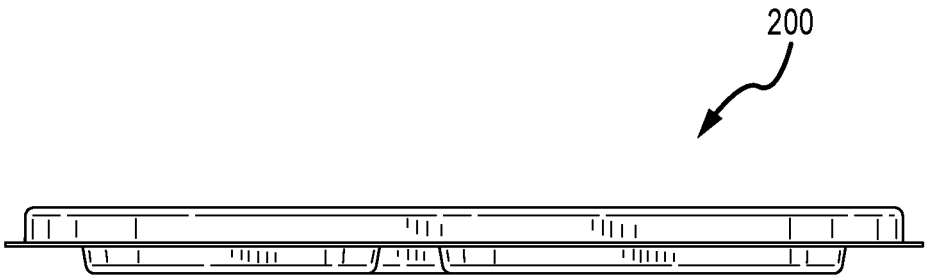
Figure 2H:
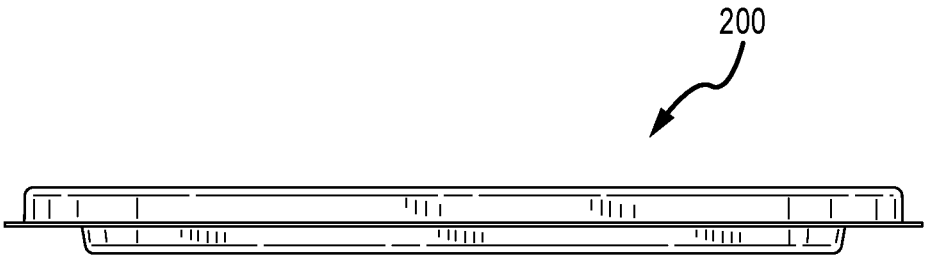

The lid perimeter inner rim 220 is adjacent to a perimeter engaging receiver (PER) 226. This PER 226 is a part of the sealing interface formed by engagement of the tray 100 and lid 200. The PER 226 is defined on the sides by an inner wall 228 and an outer wall 230. Further details of the inner wall 228 and outer wall 230 (including their engagement with the inner surface 128 and outer surface 130 of the tray 100, respectively) are provided below. The inner wall 228 projects substantially upward from the perimeter inner rim 220, while the outer surface 230 projects substantially upward from a perimeter outer rim 232, which projects from the side of the lid 200. The PER 226 is also defined by an uppermost wall 234 that spans the inner wall 228 and outer wall 230. A pull tab 225 may extend from the perimeter outer rim 232, e.g., at one or more corners, to ease removal of the lid 200 from the tray 100. The lid 200 also has major and minor axes, as well as various sides 206, 208, 210, 212, as described above in the context of the tray 100 (these are depicted in FIG. 2C). The lid 200 may also be manufactured of the same material as the tray 100.

Figure 3A:
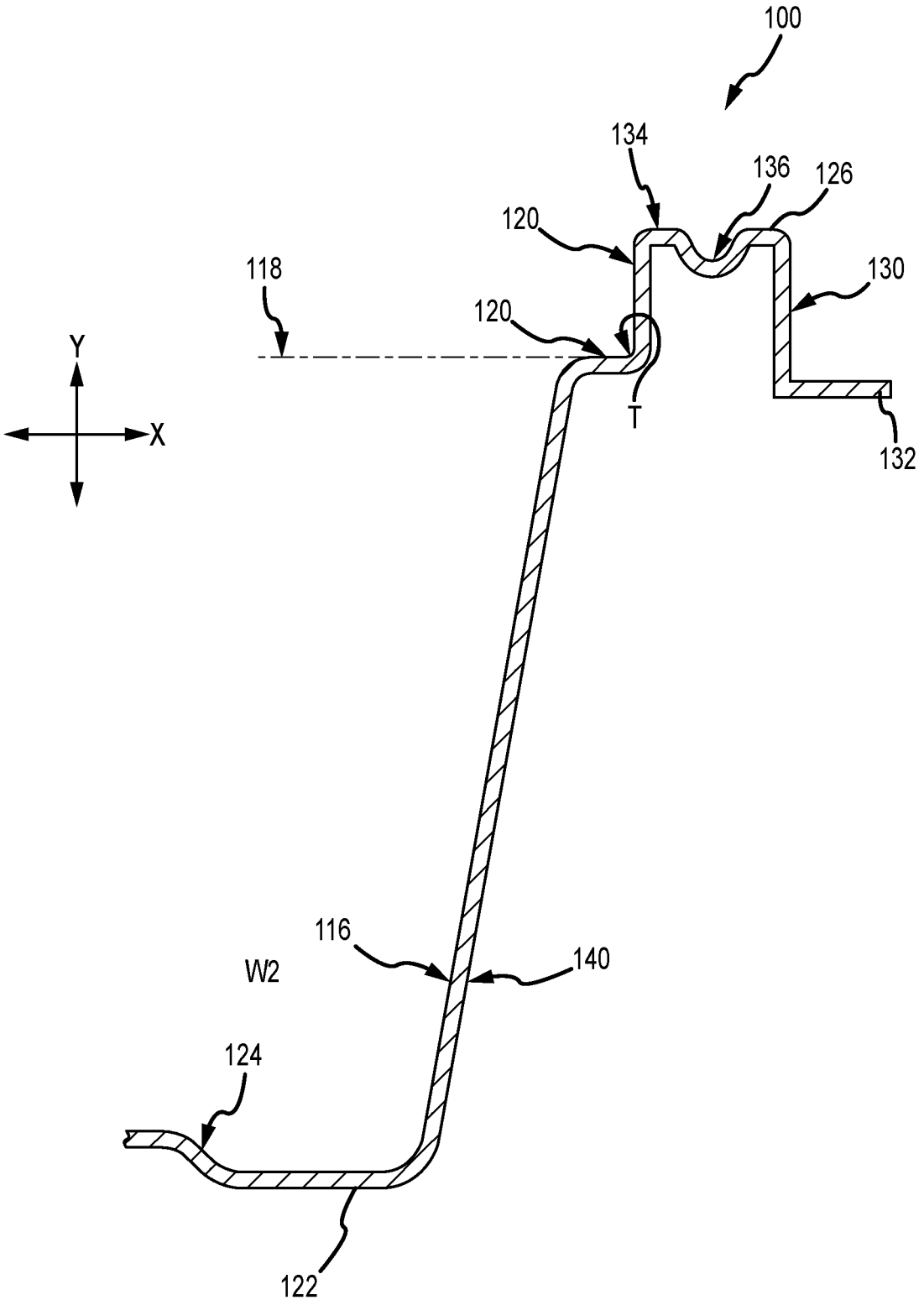
FIGS. 3A-3B are partial sectional views of an example molded fiber tray and an example molded fiber lid.
Figure 3B:
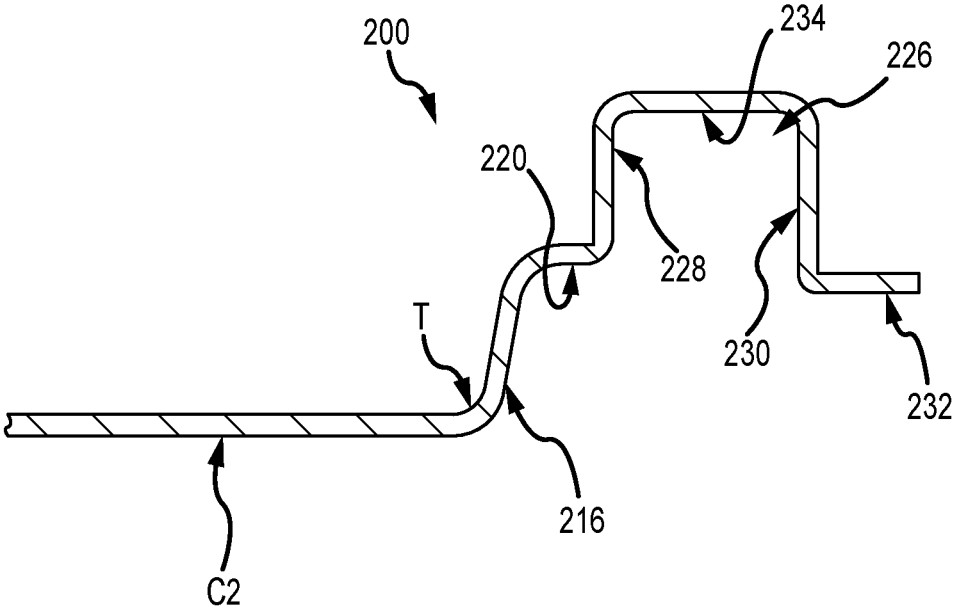
Figure 3C:
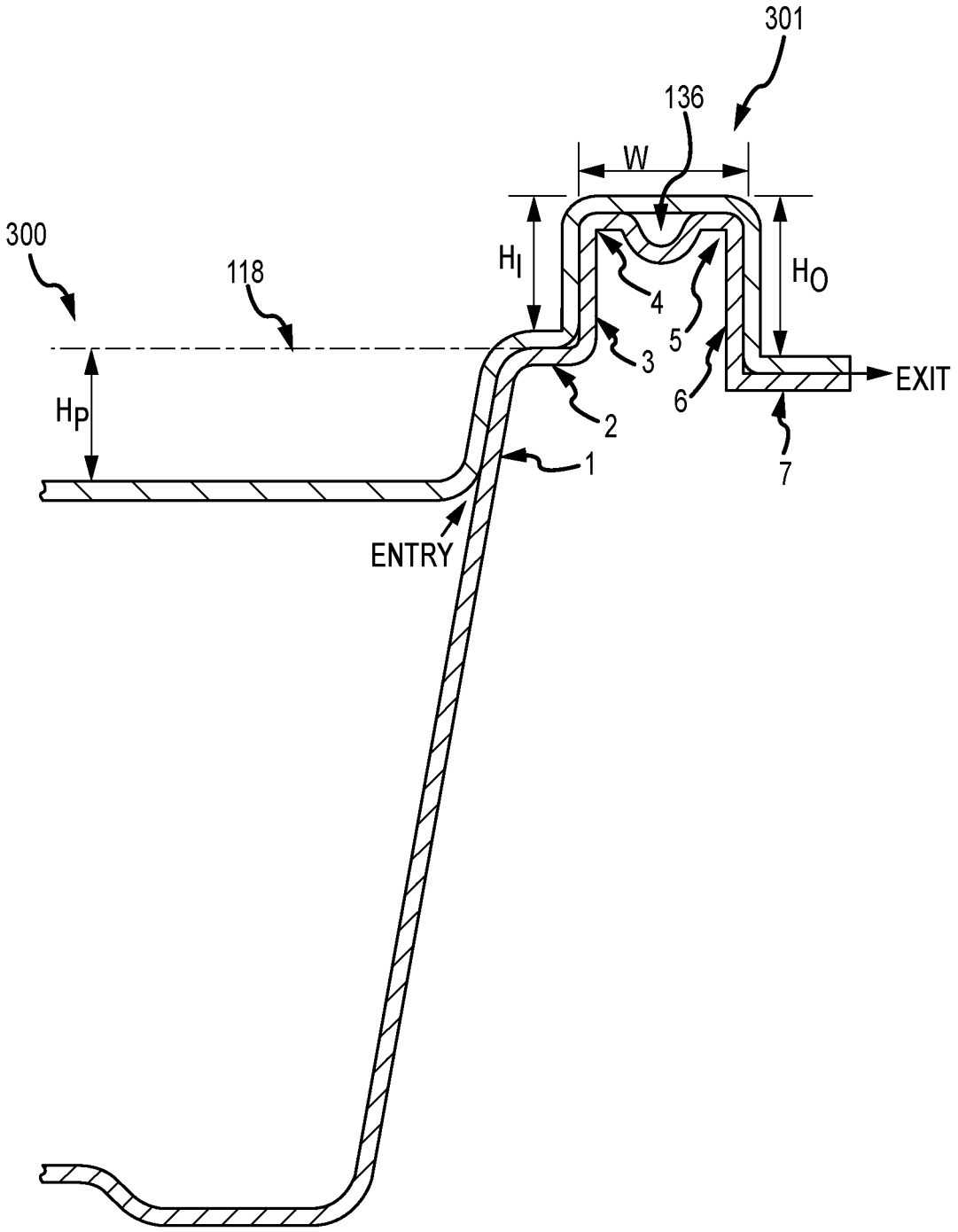
FIG. 3C is a partial sectional view of a sealed molded fiber container formed by the molded fiber tray and molded fiber lid of FIGS. 3A and 3B, respectively.

FIGS. 3A-3B are partial sectional views of an example molded fiber tray 100 and an example molded fiber lid 200. FIG. 3C is a partial sectional view of a sealed molded fiber container 300 formed by the molded fiber tray 100 and molded fiber lid 200 of FIGS. 3A and 3B, respectively. FIGS. 3A-3C describe primarily the components, surfaces, and other features that form the interface of the sealed container 300, along with other aspects of the design. Not all of the depicted features are necessarily described further or in additional detail. Specifically, FIG. 3A depicts a sectional view through the back side 108 of the tray 100, at well W2. Other sections around the various sides of the tray 100 would be configured similarly. FIG. 3A also depicts a standard Cartesian coordinate indicator having x and y axes. The components, surfaces, and other features described with regard to FIG. 3A may be measured relative to a Cartesian coordinate system as well known to persons of skill in the art. That is, a surface that is described as disposed an "a 30° angle to the x axis" would be understood to be disposed at an angle of 60° to the y axis. Further, the terms "horizontal" and "vertical" may also be used to describe surfaces oriented in the x axis only and y axis only, as understood in the art. Unless otherwise specified, angular orientations of components, surfaces, and features describe the orientation of surfaces of the tray 100 that engage with surfaces of the lid 200, since that engagement is relevant to the function of the interface. As used herein, the term "transition" describes a part of the body 102, 202 between two defined features of surface. One such transition T is depicted in FIG. 3A between the tray perimeter inner rim 120 and the PEW inner surface 128. Transitions T form a part of the component, feature, or surface to which it is adjacent. Thus, the depicted transition forms a part of the tray inner perimeter rim 120 and the PEW inner surface 128. Thus, it will be understood that the tray perimeter inner rim 120 is "adjacent" (as that term is used herein) to the PEW inner surface 128 (even in the presence of the transition T) because that transition T forms a part of each of those elements for the purposes of this description. Angular orientation of a transition T, however, if not contemplated in the context of describing the angular orientation of an element of which it forms a part. Thus, assuming the depicted PEW inner surface 128 is described as "vertical," it does not include any horizontally-oriented parts, even though the transition T forms a part thereof. Not all transitions in the tray 100 are labeled in FIG. 3A, but will be apparent to a person of skill in the art.

The inner well surface 116 is disposed at an angle to they axis of about 5°, although angular ranges of about 0°, about 1°, about 2°, about 3°, about 4°, about 0° to about 10°, about 5° to about 15°, about 10° to about 20°, about 15° to about 25°, and about 20° to about 30° are also contemplated. Smaller angles are typically advantageous on walls that form a part of the major 104 or minor 114 partitions and may allow for improved sealing between adjacent wells, so as to prevent cross-contamination. The tray perimeter inner rim 120 is disposed horizontally and is coextensive with the major partition uppermost surface 118 (depicted in broken lines, for illustrative purposes). While the tray perimeter inner rim 120 may be disposed at an angle to the horizontal, a horizontal orientation aids in reinforcing the PEW 126 as forces act vertically against the latter element. Thus, the tray perimeter inner rim 120 is able to deflect in a vertical direction, thereby absorbing forces applied to the PEW 126. The PEW inner surface 128 is vertical, as is the PEW outer surface 130; thus, the draft angle of the PEW 126 is 0°. Other draft angles, from 0° up to and including each of 0.5°, 1.0°, 1.5°, 2.0°, and 2.5° are also contemplated. While even larger draft angles may be utilized, it has been determined that the above-referenced draft angles provide the most desired performance for all types of contained foods, that is those with high to low liquid contents. The PEW uppermost surface 134 defines a groove 136 that aids in absorbing forces applied to the PEW 126, specifically those applied when the lid 200 is forced onto the tray 100 to seal it. The tray perimeter outer rim 132 is horizontally disposed. A well outer surface 142 is also depicted.

FIG. 3B depicts a sectional view through the back side 208 of the lid 200, at well ceiling C2. Other sections around the various sides 206, 210, 212 of the lid 200 would be configured similarly. FIG. 3B also depicts a standard Cartesian coordinate indicator having x and y axes; thus, the components, surfaces, and other features described with regard to FIG. 3B may be measured consistent with the descriptions provided above. Transitions T are also depicted, and are defined as described above. The well ceiling C2 is horizontal. The soffit 216 is disposed at an angle substantially similar or similar to that of the inner well surface 116. The lid perimeter inner rim 220 is disposed horizontally so as to engage with the tray perimeter inner rim 120. The PER inner wall 228 and PER outer wall 230 are angled so as to match the corresponding surfaces of the PEW (inner wall 128 and outer wall 130, respectively); thus, the draft angle of the PER 226 is 0°. Other draft angles, from 0° up to and including each of 0.5°, 1.0°, 1.5°, 2.0°, and 2.5° are also contemplated. The PER uppermost surface 234 defines the uppermost extent of the PER 226. The lid perimeter outer rim 232 is horizontally disposed.

FIG. 3C depicts the interface section 301 of the container 300 that includes the tray 100 and lid 200 of FIGS. 3A and 3B, respectively, the section views of both of which are depicted and may be read in conjunction therewith. Not all features of the tray 100 and lid 200 are depicted. The dimensions of a number of features are depicted. The distance $H_P$ from the uppermost surface of the partition to the ceiling C2 of the lid 200 is depicted. This distance may be about 5/16", about 1/2", or about 3/4". The height of the PEW 126 may be measured on either of the inner surface (at a height $H_I$) or the outer surface (at a height $H_O$). Either height may be about 5/16", about 1/2", or about 3/4". The width W of the PEW 126 may be a similar distance to the heights noted above. The combination of small draft angles of each of the partitions, the internal recesses, the PEW 126, and the PER 226, in combination with the distances described above, help seal the various wells against leakage between adjacent wells and external to the container. The distances described above form a long path that any liquid must be able to penetrate in order for leakage to occur.

FIG. 3C also depicts the path that a liquid contained in the well would be required to follow to leak from the interface. A particular advantage of the depicted configuration is the number of sealing surfaces in the interface portion. Those sealing surfaces are numbered 1-7, as counted from a hypothetical entry location of liquid to a hypothetical exit location. Sealing surface 1 is located between the inner well surface 116 and the soffit 126. Sealing surface 2 is disposed between the tray perimeter inner rim 120 and the lid perimeter inner rim 220. Sealing surface 3 is between PEW inner surface 128 and PER inner wall 228. Sealing surface 4 is between a first portion of PEW uppermost surface 134 and a first portion of PER uppermost wall 234. The groove 136 defines a small volume into which any liquid that may penetrate past sealing surfaces 1-4 may be contained, so as to limit leakage. Thus, the groove 136 acts as a liquid pressure relief, even if all of sealing surfaces 1-4 fail. Sealing surface 5 is between a second portion of PEW uppermost surface 134 and a second portion of PER uppermost wall 234. Sealing surface 6 is between the PEW outer surface 130 and the PER outer wall 230. Sealing surface 7 is between the tray outer perimeter rim 132 and the lid perimeter outer rim 232. In view of the above configuration, the hypothetical path of escape for a fluid via the interface is convoluted, with each transition T and adjacent portion of the interface 301 resisting deflection that may enable leakage to occur.

Figure 4:
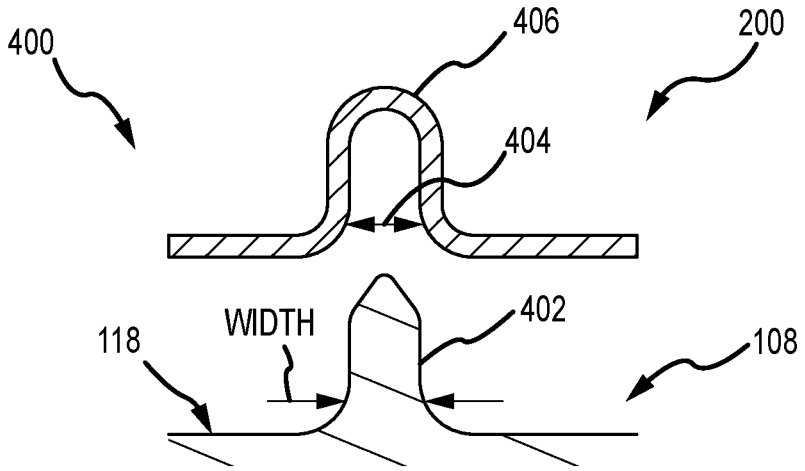
FIG. 4 is a partial view of a lock formed in the molded container.

FIG. 4 is a partial view of a lock 400 formed in the molded container 300. The lock 400 may be in the form of a projection 402 that extends above a partition uppermost surface 118 of the tray 100, which may help seal the container 300 in a location distal from the PEW 126 and PER 226. The width of the projection 402 may be substantially similar to that of a throat 404 of a keeper 406 formed on the lid 200 (more specifically, the internal channel uppermost surface thereof 218). Use of the lock 400 may improve the sealing functionality between the tray 100 and lid 200 of the container 300.

Figure 5:
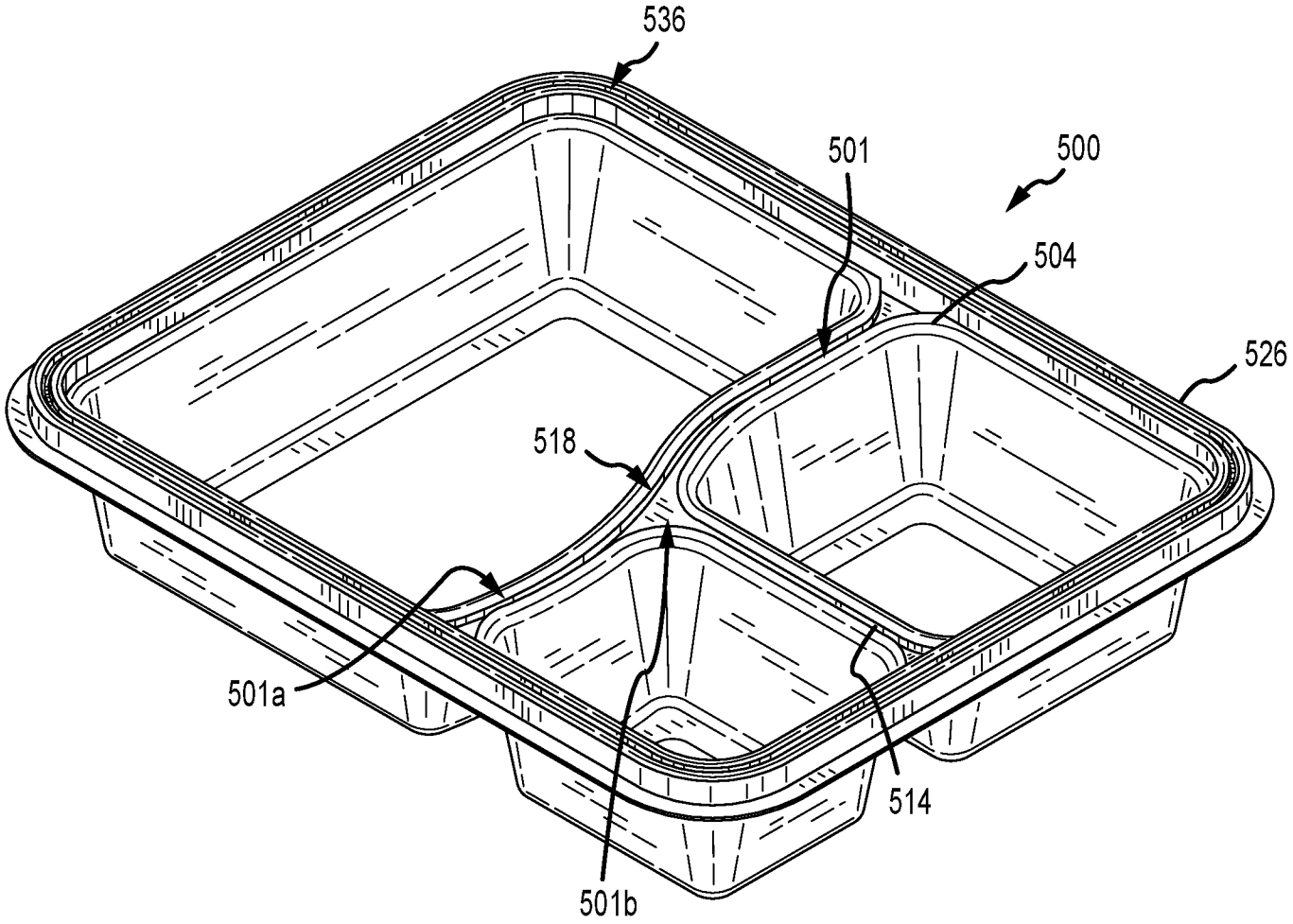
FIG. 5 is another example of a molded fiber tray.

FIG. 5 is another example of a molded fiber tray 500. The features depicted in FIG. 5 are generally similar to those depicted in FIG. 1A, as such, the features are not specifically numbered or described, but would be apparent to a person of ordinary skill in the art, upon reading the above disclosure. One difference between the depicted tray 500 and the tray depicted above is the inclusion of partition grooves 501 defined by the uppermost surface 518 of both the major partition 504 and the minor partition 514. In other examples, the partition groove 501 may be disposed on only one partition 504, 514. The depicted groove 501 includes both narrow portions 501*a* and wide portions 501*b*. The narrow portions 501*a* are disposed generally on the narrower width portions of the partitions 504, 514. The wide portions 501*b* are disposed proximate the intersection of the major partition 504 and minor partition 514 and near the ends of those features proximate the PEW 526. Thus, this inner groove 501 performs much of the same functionality as the groove 536 disposed on the PEW 526.

Figure 6:
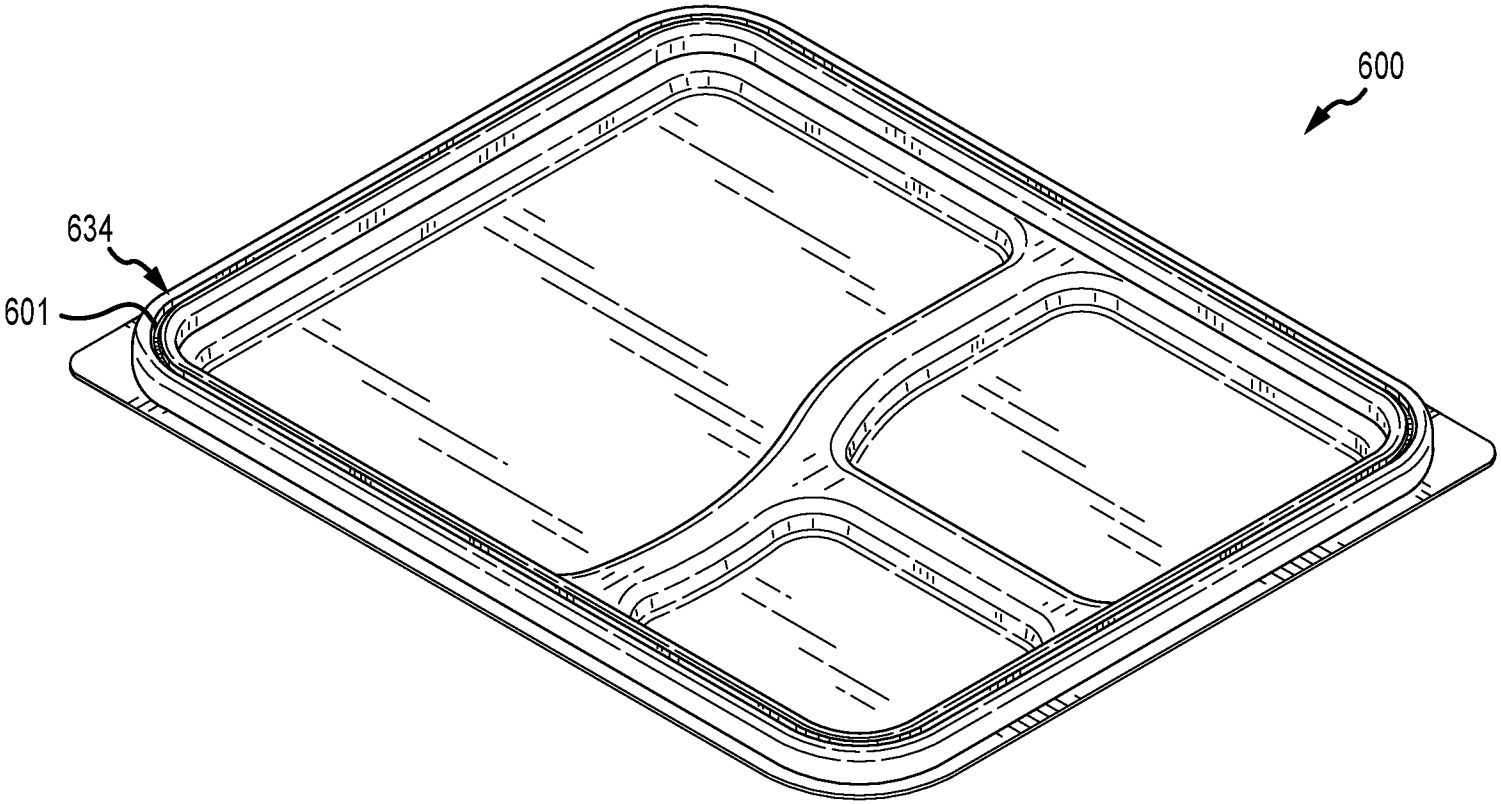
FIG. 6 depicts another example of a molded fiber lid.

FIG. 6 depicts another example of a molded fiber lid 600. The features depicted in FIG. 6 are generally similar to those depicted in FIG. 2A, as such, the features are not specifically numbered or described, but would be apparent to a person of ordinary skill in the art, upon reading the above disclosure. The depicted lid 600, however, also includes a groove 601 in the PER uppermost surface 634. This groove 601 is configured to mate with the groove defined by the PEW, e.g., as depicted in FIG. 1A. These mating grooves may further improve the sealing capability between the PEW and the PER.

Any number of the features of the different examples described herein may be combined into one single example and alternate examples having fewer than or more than all of the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A container comprising:

a molded fiber tray comprising:

a unitary fiber body defining at least one internal well, wherein the molded fiber body comprises a perimeter engaging wall extending upward from a perimeter rim of the molded fiber tray, the perimeter engaging wall comprising an inner surface, an outer surface, and an uppermost surface spanning the inner surface and the outer surface, and wherein the uppermost surface of the perimeter engaging wall at least partially defines a continuous groove that extends along the uppermost surface; and a molded fiber lid comprising:

a unitary fiber body comprising at least one ceiling, and wherein the unitary fiber body defines a perimeter engaging receiver extending upward from a perimeter rim of the molded fiber lid, the perimeter engaging receiver at least partially defined by an inner wall, an outer wall, and an uppermost wall spanning the inner wall and the outer wall, wherein the perimeter engaging wall is configured to be removably received in the perimeter engaging receiver, wherein, when so received, the inner surface contacts the inner wall, the outer surface contacts the outer wall, and the uppermost surface contacts the uppermost wall, wherein, when so received, the at least one internal well and the at least one ceiling define a substantially sealed internal volume, and wherein the continuous groove and the uppermost wall define a small volume into which liquid that penetrates past sealing surfaces is contained to limit leakage and act as a pressure relief.

2. The container of claim 1, wherein the unitary fiber body of the molded fiber tray further comprises at least one partition that subdivides the internal well into a plurality of wells, and wherein the unitary fiber body of the molded fiber lid defines at least one internal channel that subdivides the at least one ceiling into a plurality of ceilings, wherein the at least one internal channel is configured to mate with the at least one partition, and wherein, when so mated, each of the plurality of wells and plurality of ceilings define a discrete substantially sealed internal volume.

3. The container of claim 1, wherein the perimeter rim of the molded fiber tray is disposed substantially orthogonal to the outer surface and the inner surface.

4. The container of claim 3, wherein the perimeter rim of the molded fiber tray comprises an outer rim disposed adjacent the outer wall and an inner rim disposed adjacent the inner wall, and wherein the inner rim is adjacent the at least one well.

5. The container of claim 1, wherein the perimeter rim of the molded fiber lid is disposed substantially orthogonal to the outer wall and the inner wall.

6. The container of claim 5, wherein the perimeter rim of the molded fiber lid comprises an outer rim disposed adjacent the outer surface and an inner rim disposed adjacent the inner surface, and wherein the molded fiber lid further comprises at least one soffit disposed between the inner rim and the at least one ceiling.

7. The container of claim 1, wherein the molded fiber lid further comprises at least one tab extending from the perimeter rim.

8. The container of claim 2, wherein the at least one partition comprises a major partition extending from a first side of the molded fiber tray to a second side of the molded fiber tray.

9. The container of claim 8, wherein the at least one partition further comprises a minor partition extending from a third side of the molded fiber tray to the major partition.

10. The container of claim 2, wherein the at least one partition at least partially defines a groove.

11. A container comprising:

a molded fiber tray comprising:

a unitary fiber body defining at least two internal wells, separated by a partition comprising a first well surface, a second well surface, and a partition uppermost surface spanning the first well surface and the second well surface, wherein the molded fiber body comprises a perimeter engaging wall extending upward from a perimeter rim of the molded fiber tray and at least partially surrounding both of the two internal wells, the perimeter engaging wall comprising an inner surface, an outer surface, and an uppermost surface spanning the inner surface and the outer surface, wherein the perimeter engaging wall uppermost surface at least partially defines a groove therein, and wherein the perimeter engaging wall uppermost surface is disposed at an elevation different than an elevation of the partition uppermost surface; and a molded fiber lid comprising:

a unitary fiber body comprising at least one ceiling, a soffit extending from the at least one ceiling and defining an internal recess, a perimeter engaging receiver extending upward from a perimeter rim of the molded fiber lid, the perimeter engaging receiver at least partially defined by an inner wall, an outer wall, and an uppermost wall spanning the inner wall and the outer wall, wherein the partition is configured to be removably received in the internal recess, wherein, when so received, the soffit contacts at least one of the first well wall and the second well wall, wherein the perimeter engaging wall is configured to be removably received in the perimeter engaging receiver, wherein, when so received, the inner surface contacts the inner wall, the outer surface contacts the outer wall, and the uppermost surface contacts the uppermost wall, wherein the groove and the uppermost wall define a small volume into which liquid that penetrates past sealing surfaces is contained to limit leakage and act as a pressure relief, and wherein, when so received, the at least one internal well and the at least one ceiling define a substantially sealed internal volume.

12. The container of claim 11, wherein the groove is continuous and extends along the uppermost surface.

* * * * *